US009452348B2

(12) United States Patent
Berube et al.

(10) Patent No.: US 9,452,348 B2
(45) **Date of Patent: *Sep. 27, 2016**

(54) CARD DEALING SHOE

(71) Applicant: DEQ Systems Corp., Levis (CA)

(72) Inventors: Real Berube, Levis (CA); Guillaume Pouliot, Levis (CA); Patryck Rouleau, L'Ancienne-Lorette (CA)

(73) Assignee: DEQ Systems Corp., Levis, Quebec (CA)

( * ) Notice: Subject to any disclaimer, the term of this patent is extended or adjusted under 35 U.S.C. 154(b) by 0 days.

This patent is subject to a terminal disclaimer.

(21) Appl. No.: 14/218,843

(22) Filed: Mar. 18, 2014

(65) Prior Publication Data

US 2014/0291930 A1 Oct. 2, 2014

Related U.S. Application Data

(63) Continuation-in-part of application No. 13/963,827, filed on Aug. 9, 2013.

(60) Provisional application No. 61/681,468, filed on Aug. 9, 2012.

(51) Int. Cl.
*A63F 1/14* (2006.01)

(52) U.S. Cl.
CPC ..... *A63F 1/14* (2013.01)

(58) Field of Classification Search
CPC ..... A63F 1/12; A63F 1/14
USPC ..... 273/149
See application file for complete search history.

(56) References Cited

U.S. PATENT DOCUMENTS

| | | | | |
|---|---|---|---|---|
| 2,185,474 | A * | 1/1940 | Nott | 273/149 R |
| 3,313,302 | A * | 4/1967 | Lasley et al. | 209/608 |
| 3,359,150 | A * | 12/1967 | Stoothoff et al. | 156/379 |
| 3,402,661 | A * | 9/1968 | Barbour et al. | 101/269 |
| 4,008,562 | A * | 2/1977 | Vecera et al. | 57/412 |
| 5,265,452 | A * | 11/1993 | Dawson et al. | 70/278.3 |
| 5,382,024 | A * | 1/1995 | Blaha | 273/149 R |
| 6,582,301 | B2 * | 6/2003 | Hill | 463/11 |
| 6,637,622 | B1 * | 10/2003 | Robinson | 221/268 |
| 7,407,438 | B2 * | 8/2008 | Schubert et al. | 463/22 |
| 7,593,544 | B2 * | 9/2009 | Downs et al. | 382/100 |
| 7,699,694 | B2 * | 4/2010 | Hill | 463/11 |
| 7,769,232 | B2 * | 8/2010 | Downs, III | A63F 1/14 273/148 A |
| 7,926,809 | B2 * | 4/2011 | Tseng | 273/256 |
| 7,946,586 | B2 * | 5/2011 | Krenn et al. | 273/149 R |
| 7,971,881 | B2 * | 7/2011 | Toyama | A63F 1/12 209/534 |
| 8,170,323 | B2 * | 5/2012 | Downs et al. | 382/141 |
| 8,353,512 | B2 * | 1/2013 | Masuda | B65H 5/26 271/186 |
| 8,353,513 | B2 * | 1/2013 | Swanson | 273/149 R |
| 8,538,155 | B2 * | 9/2013 | Downs et al. | 382/181 |
| 8,590,896 | B2 * | 11/2013 | Krenn | A63F 1/14 273/149 P |
| 8,636,285 | B2 * | 1/2014 | Grauzer et al. | 273/149 R |
| 8,646,779 | B2 * | 2/2014 | Grauzer et al. | 273/149 R |
| 8,662,500 | B2 * | 3/2014 | Swanson | 273/149 R |
| 2014/0042697 | A1 * | 2/2014 | Berube et al. | 273/149 R |

* cited by examiner

*Primary Examiner* — Michael Dennis
*Assistant Examiner* — Dolores Collins
(74) *Attorney, Agent, or Firm* — Newman Law, LLC

(57) ABSTRACT

A card dealing shoe including a sloped base with an opening, a roller mounted for rotational motion on an axle connected at each of the opposing side walls, and a pivoting lever having a first end and an opposing second end, wherein the first end protrudes from the opening in the sloped base, the pivoting lever being configured to pivot from a first position wherein the first end protrudes from the opening in the sloped base and the second end restricts rotational motion of the roller to a second position in which the second end permits rotational motion of the roller, wherein the lever is biased towards the first position.

8 Claims, 8 Drawing Sheets

FIG. 10
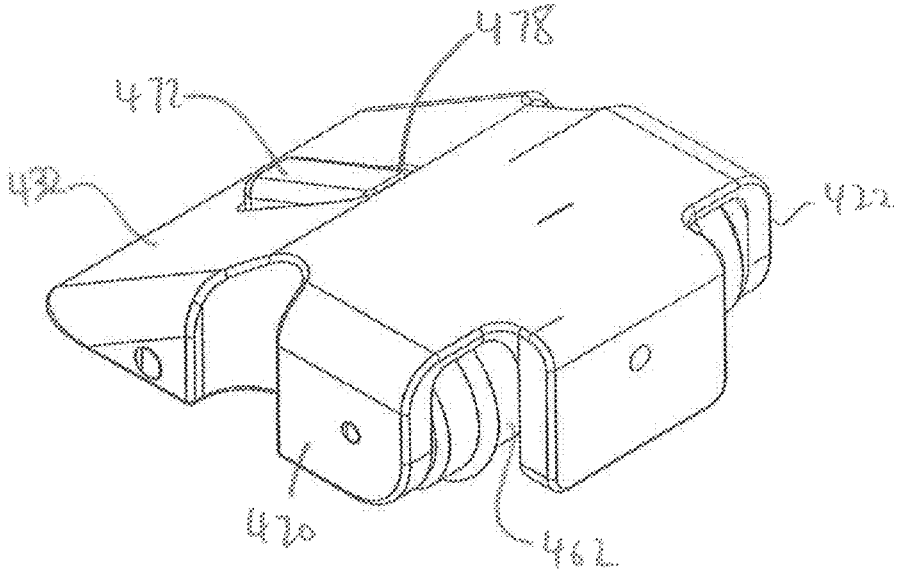
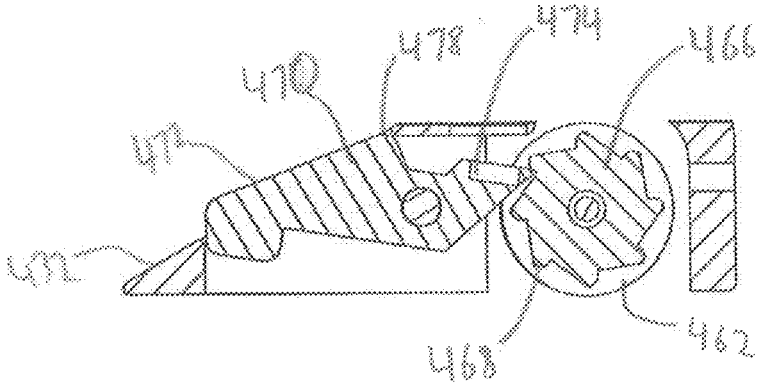
FIG. 12
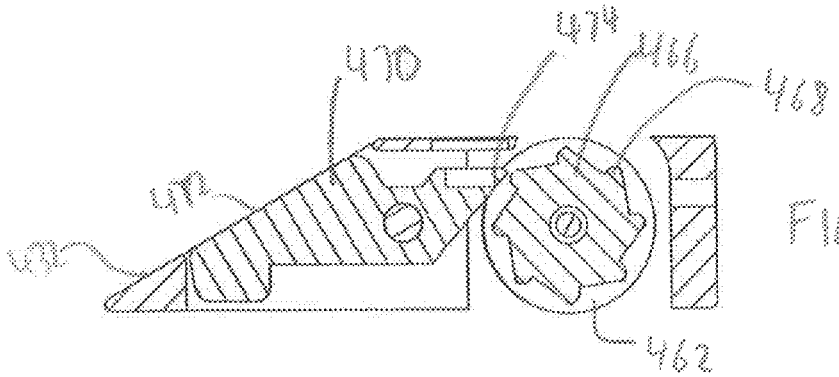
FIG. 13

CARD DEALING SHOE

CROSS-REFERENCE TO RELATED APPLICATIONS

This application claims the benefit of U.S. patent Ser. No. 13/963,827 filed on Aug. 9, 2013, which in turn claims priority to U.S. Provisional Patent Application No. 61/681,468, which was filed Aug. 9, 2012, the disclosures of which are incorporated herein by reference.

BACKGROUND OF THE INVENTION

The invention relates to playing card dispensing apparatus, and in particular, to playing card dealing shoes that are configured to facilitate play of both wagering and non-wagering card games.

Playing card dealing shoes used for delivering cards in the play of card games are well known. In operation, one or more decks of randomly ordered cards may be placed laterally in a stack onto a sloped surface of an enclosed space within the shoe. These shoes typically have a card feed slot at the lower end of the sloped surface through which the cards can be separated from the stack one at a time, and an opening to facilitate manually engaging the top card in the stack to force it through the slot by sliding it laterally away from the stack.

While shoes of this type are adequate for delivering cards one-by-one to game players of a card game, there is room for improvement, particularly for reasons of security and game integrity. Although the shoe is typically placed on the casino table in full view of the dealer and/or players, many events can occur that pose challenges to the integrity or security of the game, intentionally or otherwise, and regardless of whether the game is played for money or fun. Therefore there is a continual need for improvements in the shoes of the general type described above to identify such events, eliminate weaknesses and minimize potential threats to game security and integrity.

SUMMARY OF THE INVENTION

In some embodiments, the invention is generally directed to a card dealing shoe for facilitating play of card games which includes: A card dealing shoe for facilitating play of card games, comprising: an elongated housing defining a card staging area therein, the housing including a sloped base including an opening, opposing side walls and a sloped front wall separated from the base adjacent to a front end of the housing to form a card feed slot from which cards may be manually removed from the card staging area; a roller mounted for rotational motion on an axle connected at each of the opposing side walls; and a pivoting lever having a first end and an opposing second end, wherein the first end protrudes from the opening in the sloped base, the pivoting lever being configured to pivot from a first position wherein the first end protrudes from the opening in the sloped base and the second end restricts rotational motion of the roller to a second position in which the second end permits rotational motion of the roller, wherein the lever is biased towards the first position.

In some embodiments, the card dealing shoe further comprises a disc connected to the roller for simultaneous rotational motion therewith, the disc including a plurality of radially extending spurs, wherein the diameter of the roller is greater than the diameter of the disc including the radially extending spurs, and the second end of the pivoting lever is positioned to come into contact with at least one of the radially extending spurs upon the pivoting lever being placed in the first position.

In some embodiments, a card being manually removed from the card staging area comes into contact with the first end of the pivoting lever.

In some embodiments, the pivoting lever is mounted on an axle extending between the opposing side walls.

In some embodiments, the second end moves from being in contact with the at least one of the radially extending spurs upon the lever being positioned in the second position.

Some embodiments of the invention are directed to a card dealing shoe for facilitating play of card games, comprising: an elongated housing defining a card staging area therein, the housing including a sloped base including an opening, opposing side walls and a sloped front wall separated from the base adjacent to a front end of the housing to form a card feed slot from which cards may be manually removed from the card staging area; a roller mounted for rotational motion on an axle connected at each of the opposing side walls; a disc connected to the roller for simultaneous rotational motion therewith, the disc including a plurality of radially extending spurs, wherein the diameter of the roller is greater than the diameter of the disc including the radially extending spurs; and a pivoting lever having a first end and an opposing second end, wherein the first end protrudes from the opening in the sloped base, the pivoting lever being configured to pivot from a first position the first end protrudes from the opening in the sloped base and the second end restricts rotational motion of the roller to a second position in which the second end permits rotational motion of the roller, wherein the lever is biased towards the first position.

BRIEF DESCRIPTION OF THE DRAWINGS

Certain embodiments are disclosed with reference to the following drawings.

FIG. 10 illustrates a perspective view of another embodiment of the invention in which the ramp portion of the shoe includes a shoe movement restricting apparatus;

FIGS. 12-13 provide cross sectional views of the embodiment shown in FIG. 10, in which a pivoting lever is moved from a first position to a second position.

DETAILED DESCRIPTION OF SOME EMBODIMENTS OF THE INVENTION

Figure 1:
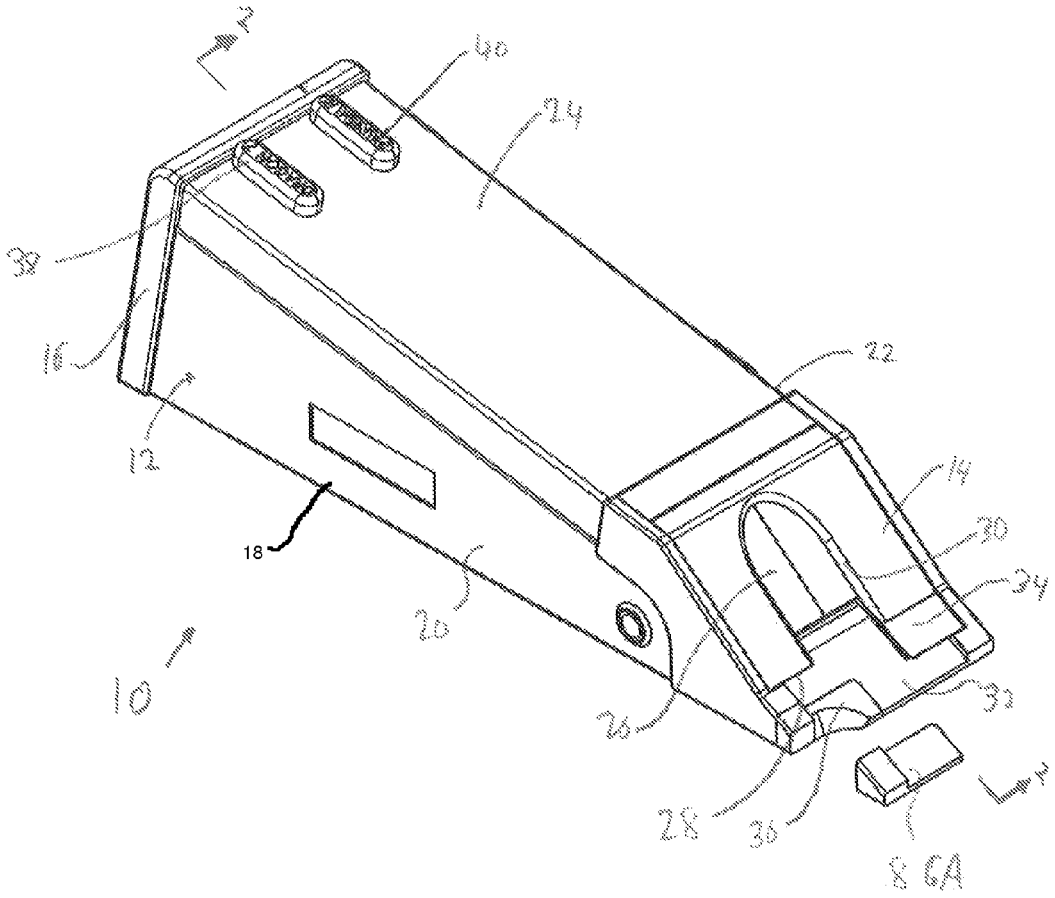
FIG. 1 illustrates a perspective view of an exemplary card dealing shoe constructed according to some embodiments of the invention.

In the following detailed description, reference is made to the accompanying drawings which form a part of this application. The drawings provide and illustrate specific exemplary embodiments in which the invention may be practiced. It is to be understood that other embodiments may be utilized and structural changes may be made without departing from the scope of the invention.

Unless otherwise apparent or stated, directional references, such as "upper", "lower", "front", "rear", "frontward", "rearward", "vertical", "horizontal", "top", "bottom" and the like are intended to be relative to the orientation of a particular embodiment of the invention as shown in the figures. In addition, a given reference numeral in the drawings indicates the same or similar structure when it appears in different figures, and like reference numerals identify similar structural elements and/or features of the subject invention.

Figure 3:
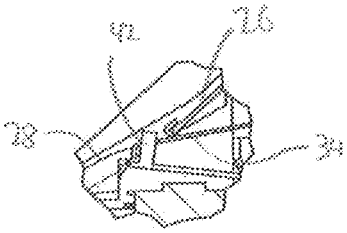
FIG. 3 illustrates a close-up detail view of the card feed slot area of the shoe along section E.
Figure 2:
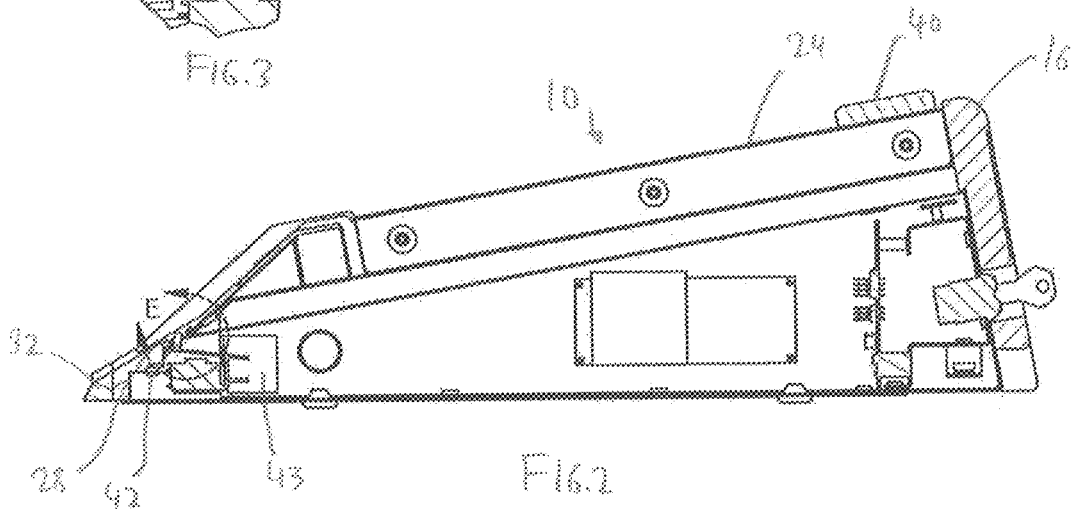
FIG. 2 illustrates a cross-sectional view of the shoe of FIG. 1 taken along line 2-2.

FIGS. 1-3 illustrates an exemplary card dealing shoe constructed in accordance with some embodiments of the invention and generally referred to by the reference numeral 10. Shoe 10 includes an outer frame 12 consisting of a sloped front wall 14, rear wall 16, sloped support base 18 and opposing side walls 20 and 22, all of which cooperate to form a generally elongated housing defining an interior enclosed card stack receiving space or staging area (not shown) beneath a cover 24.

Cover 24 may be removed to allow for a stack of cards (not shown) to be placed face-down within the receiving or staging space so that they stand sideways with their respective side edges contacting sloped support base 18. In some embodiments, rear wall 16 provides for keyed entry into the housing and must be accessed for in order to remove cover 24. The entire stack is tilted on sloped support base 18 at an angle which generally corresponds with the angle of sloped front wall 14 and a top card in the stack, generally identified by reference numeral 26, is forced against the interior side of front wall 14 by the remaining cards in the stack behind it, which in turn may be pressed by a pushing device (not shown) that pushes the stack of cards towards front wall 14. Sloped front wall 14 therefore provides a barrier against which card 26 and the stack may remain at rest.

Front wall 14 extends towards sloped support base 18 to define a card feed slot 28. Card feed slot 28 has a height which is no less than the width of an edge of a playing card, and a width which is no less than the length of a playing card, thus allowing at least one playing card to pass through slot 28. Front wall 14 includes a cut-away portion 30 which reveals a greater surface area of the face down side of card 26. Front wall 14 may further include brushes which extend into slot 28.

When dealing cards from shoe 10, cut-away portion 30 permits finger access to card 26 so that a frictional engagement can be formed for causing card 26 to move down through slot 28 and out over a ramp 32. Ramp 32 includes a hollow interior portion and containing a card recognition sensor with a window 34 which is substantially flush with the card traveling surface of ramp 32. The sensor in this embodiment is a camera, but could be any image capturing device or a scanner. A light source (not shown) may be included to enhance the detection capabilities of the sensor. The light source may include any means for creating illumination to assist the sensor, such as an LED or light emitting paint disposed on surfaces adjacent to the sensor as necessary. The sensor and/or window 34 may be positioned so that the corner area of each card passes over window 34 and allows the sensor to read card information including rank and suit. As each card is moved down through slot 28 it physical contacts window 34 thus allowing the sensor to read the card. Ramp 32 may be configured to interchangeably allow for an indented corner portion 36 for creating a free space to facilitate using the thumb in removing and grasping card 26 from ramp 32 or a solid corner portion 36A. Once the card is removed, the successive card in the stack is pressed against front wall 14 to become card 26.

Information obtained from the sensor may be communicated to an control system mounted within frame 12 of shoe 10. The control system may include one or more processors, data storage devices and other computer components for processing the card recognition data from the sensor. Data from the sensor may alternatively or also be communicated to a remote system. The control system may use a variety of methods for identifying each card associated with the data received from the sensor, such as by comparing one or more images or patterns included in the data received in connection with each card drawn from shoe 10 against a database of known images or patterns for each card until a likely match is determined.

The control system may be configured or otherwise be made aware of the game being played for purposes of using the information received to detect game outcomes or bonus game outcomes. For example, shoe 10 may be used with the game of baccarat and the control system can be configured to apply the rules of baccarat as cards are identified by the sensor in order to determine the results of the game and indicate the game outcome, that is, whether the banker hand won, the player hand won or a tie occurred. The game outcome may be indicated by illuminating lamps on shoe 10, such as lamps 38 and 40. Lamps 38 and 40 may also be used to indicate that wagers placed on side wagers or bets should be paid, such as the Dragon 7™ or Panda 8™ which are part of the EZ Baccarat™ game and all available commercially in various jurisdictions throughout the world from DEQ Systems Corp.

The control system is further configured to make an assessment of conditions for the purpose of detecting whether an alarm condition exists. The alarm conditions may be related to a variety of detectable events, such as in the case of game play or in an effort to thwart tampering. For example, the alarm condition may be triggered if a card is inserted into the card receiving or staging area rather than being removed. In another example, the alarm condition may be triggered upon game events such as the end of a round. Data regarding a variety of factors may be collected and compared with normal data for purposes of determining whether an alarm condition exists.

The control system may be further configured to detect the relative randomness of the order of cards in the stack in order to alert if the stack of cards lacks randomness or otherwise fails to satisfy a desirable or preset criteria for randomness. In some embodiments, the control system performs this analysis each time a new card is drawn with the help of an algorithm to determine whether there is sufficient likelihood that the cards have been randomly shuffled prior to being inserted in shoe 10. In other embodiments, the results of the game are compared with preset statistical values, based on the odds or other factors, which may relate to the number or amount of wagers paid out to players in the game. For example, if particular outcome or set of outcomes occur which is statistically unlikely, or a player position is consistently winning large wagers over a period of time, then these events may cause the control system to trigger the alarm condition. If for any reason there is a detection of non-randomness, then an alarm condition is triggered.

By triggering the alarm condition, the control system may communicate a signal, actuate an audio device on shoe 10 or elsewhere, illuminate a lamp such as a flashing lamp on shoe 10 or elsewhere, and/or actuate the engagement of a card restraining apparatus operatively associated with shoe 10 to prohibit further game play, and in particular, prohibit further game play by physically restraining the cards and/or restricting movement of any cards through slot 28 from or into the card staging area.

In one embodiment, the restraining apparatus involves the actuation of a locking pin 42 to restrict movement through slot 28. Pin 42 is retractably mounted in ramp 32 to be driven into slot 28 by a electrical motor 43 housed in ramp 32 for the purpose of creating a barrier to card removal from, or insertion into, the card staging area. Pin 42 may also be driven into slot 28 to block card removal or card insertion upon the control system detecting that a round of game play has ended, and then retracted upon the occurrence of a new game, a game reset or after all wagers are received and the game is locked for further wagers, for example, which is detected by the control system.

The control system may be further configured to provide a variety of reports or other information relating to the cards dealt and play of the game in which the cards are dealt. For example, the control system may communicate with a display device for presenting real-time and historic results of the game play and/or side wagers. The control system is also capable of identifying when more than one card has passed over the sensor window 34 and when a card has been inserted through slot 28 from the outside to become the new next card dealt. For example, the card passing over the sensor window 34 may result in abnormal data, including images or patterns from which it can be determined that the card passed over the sensor window 34 from the outside of slot 28 to the inside of shoe 10, rather than the other way around. The control system may react to a detection of such activity be causing pin 42 to be driven into slot 28 to prevent further card removal.

Figures 4, 5:
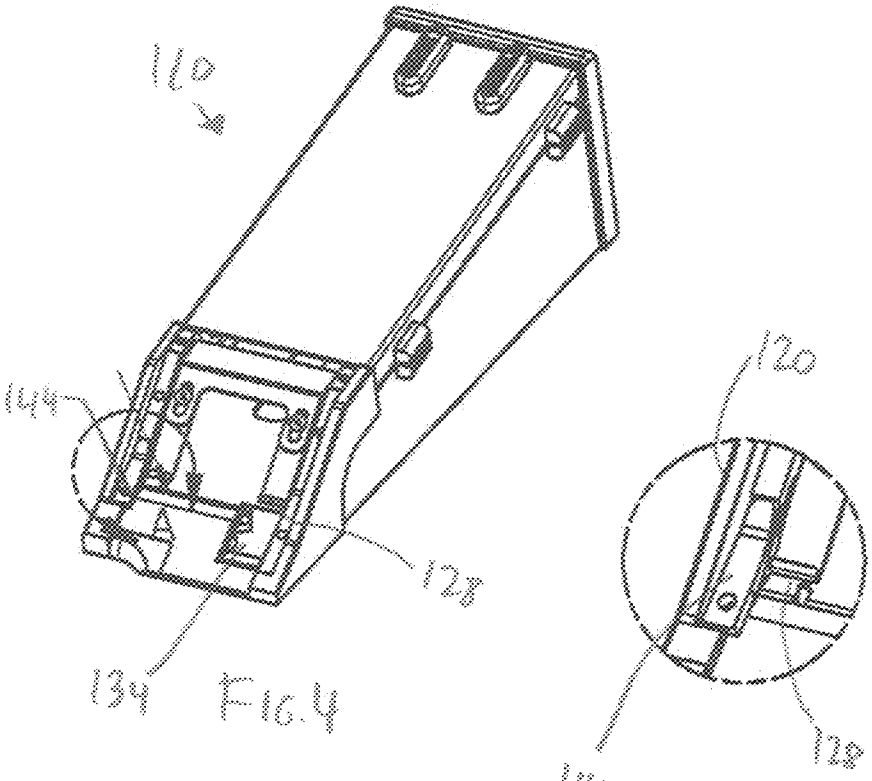
FIG. 4 illustrates a perspective view of another exemplary embodiment of a card dealing shoe of the invention.
FIG. 5 illustrates a close-up view of the card dealing shoe in FIG. 4 along section A.

In some embodiments, a shoe 110 as shown in FIGS. 4 and 5, includes a feed slot 128 with an adjustable width to allow for different dimensions of cards and ensure that a desirable portion of each card passes over the sensor, among other things. A slot adjuster bar 144 may be moved laterally, from a position in which it is flush with side wall 120, into the space defined by slot 128, thus decreasing the width of slot 128. Slot adjuster bar may also be used to force sideways movement prior to drawing cards out over ramp 132, causing more area of the card to contact window 134 for viewing by the sensor, and thus increasing the likelihood of improved sensing efficiency.

Figure 6:
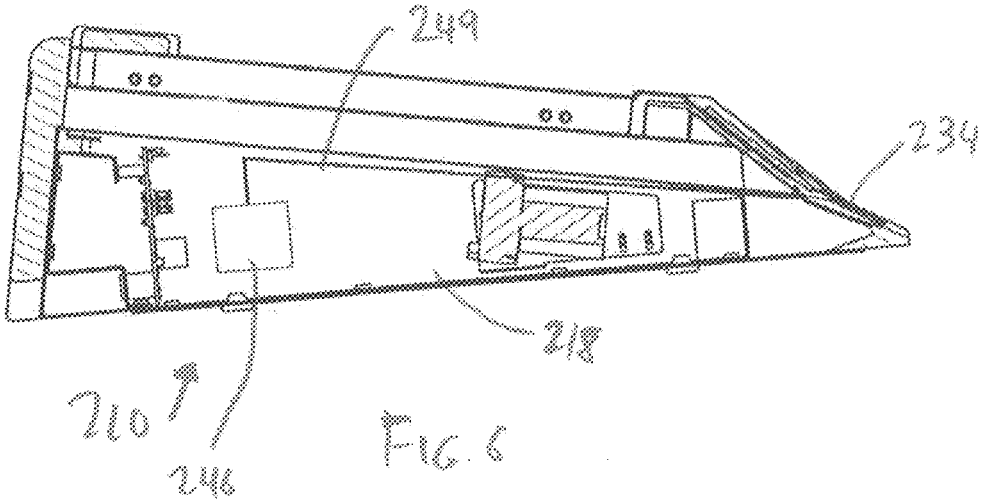
FIG. 6 illustrates a cross-sectional view of another exemplary embodiment of a card dealing shoe of the invention.

In some embodiments, a shoe 210 as shown in FIG. 6 includes a sensor window cleaning system with an air compressor 246 mounted in a base 218 and conduits 249 having an inlet at the air compressor 246 and one or more outlets adjacent to the sensor and or window 234 for delivering pressurized air from compressor 246 thereto.

Figure 7:
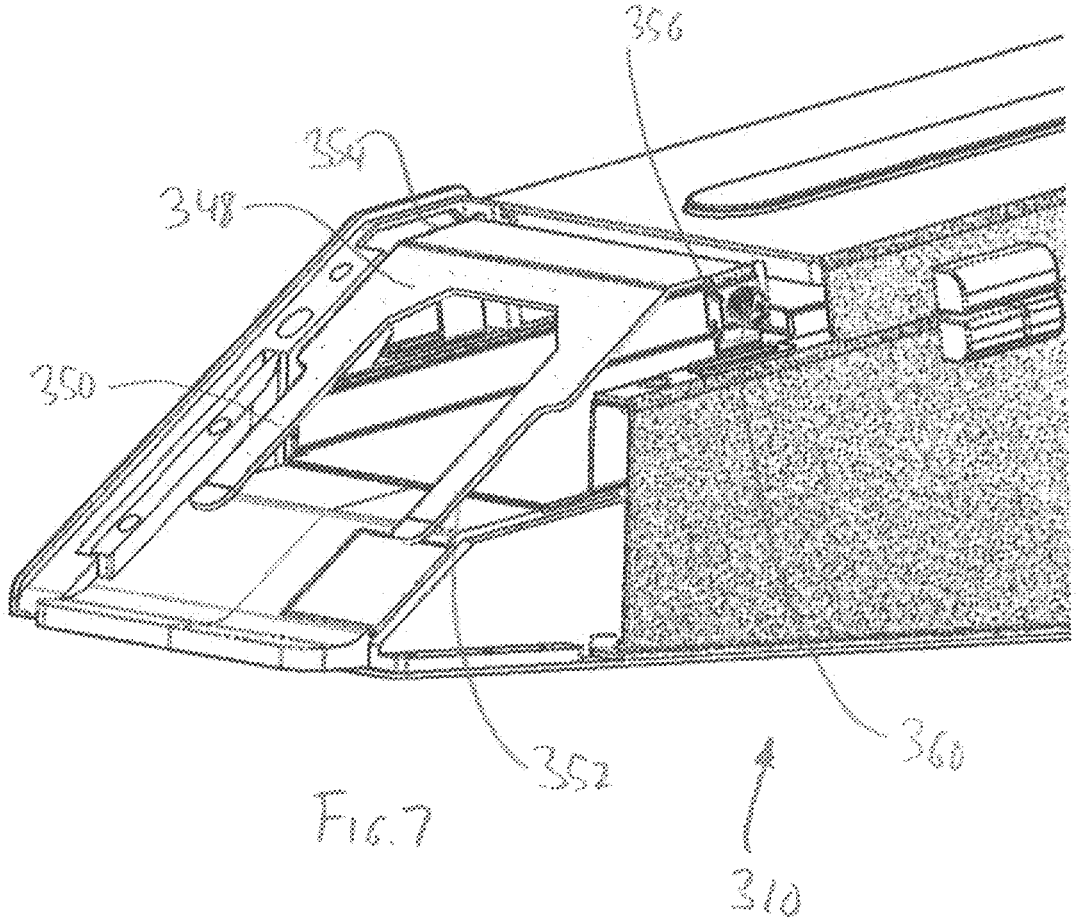
FIG. 7 illustrates a partial cross-sectional view of a portion of another exemplary embodiment of a card dealing shoe of the invention.
Figure 9:
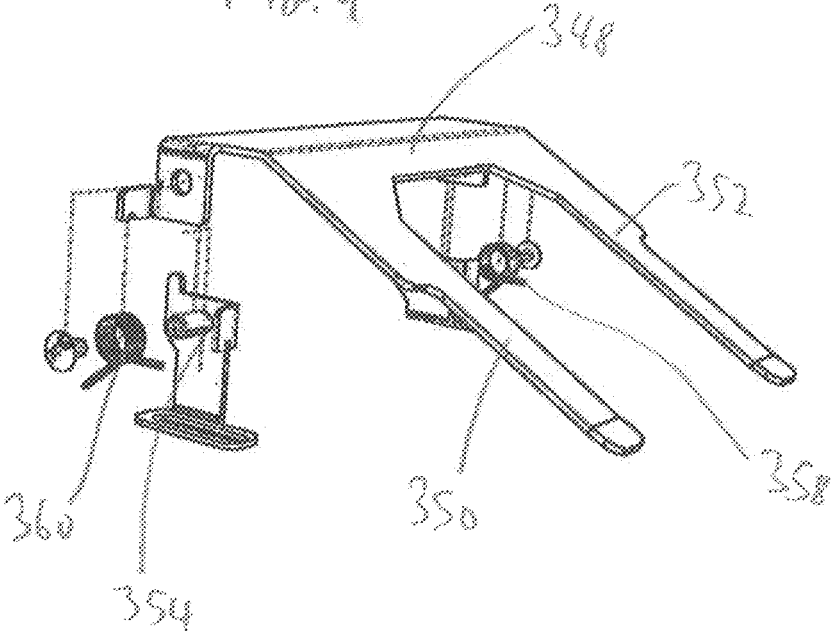
FIG. 9 illustrates an exploded view of the restraining element shown in FIG. 8.
Figure 8:
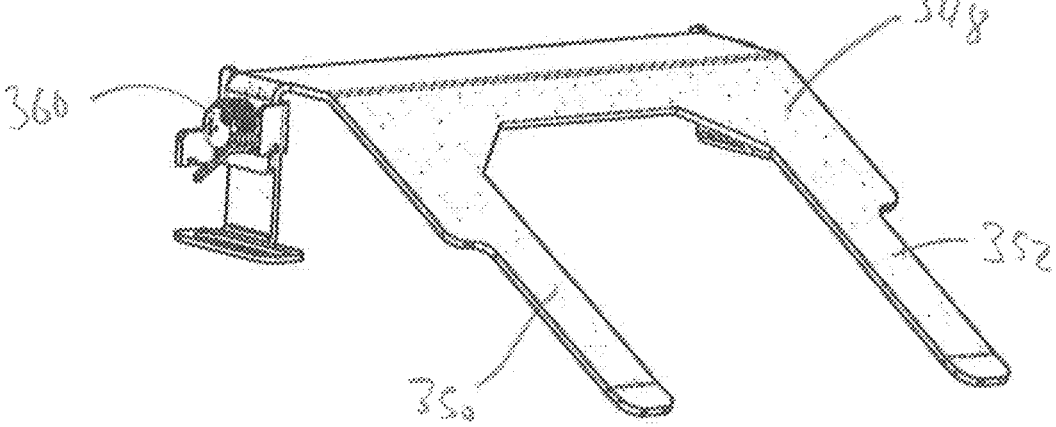
FIG. 8 illustrates a restraining element of the card dealing shoe shown in FIG. 7 removed from the shoe.
Figure 11:
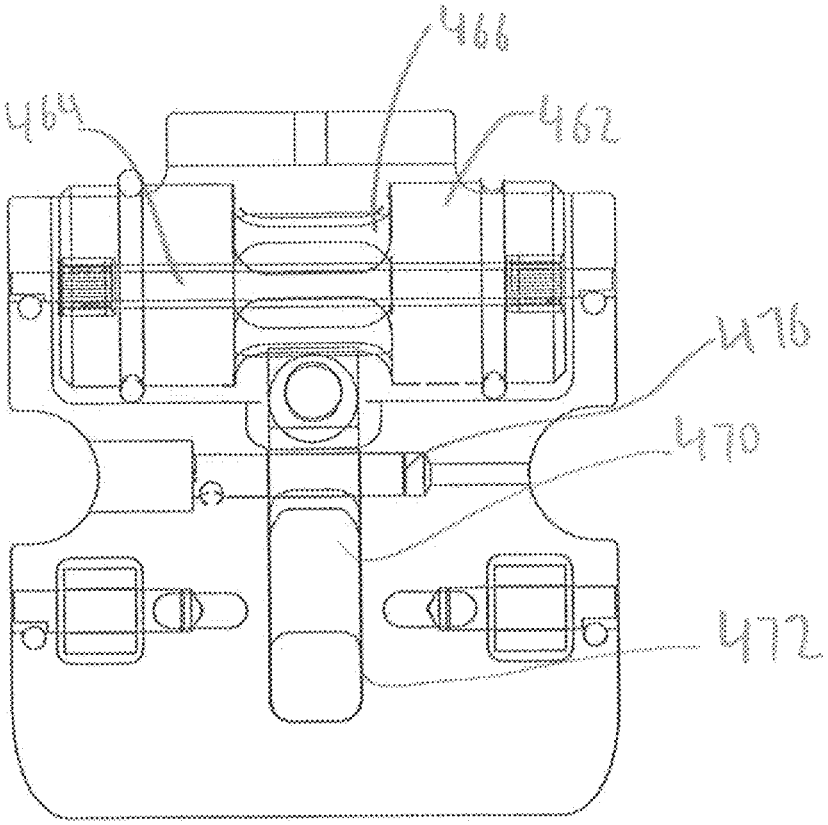
FIG. 11 illustrates a schematic view of the embodiment shown in FIG. 10.

In some embodiments, a shoe 310 as shown in FIGS. 7-9 includes a card restraining apparatus with a card restraining member or barrier 348 disposed behind the front wall (not shown in FIGS. 7-9). Barrier 348 includes dual arms 350 and 352 which contact the front card of the stack and when actuated restrain card removal thereof between game rounds or during game play at times when cards should not be removed from the stack in shoe 310. Barrier 348 is pivotally mounted about joints 354 and 356 and biased against the cards in the card staging area by one or more adjustable biasing members 358 and 360 mounted at joints 354 and 356. The adjustable biasing members may include springs. During normal game play, biasing members 358 and 360 may apply some amount of biasing force through barrier 348 onto the cards in the card staging area but the amount is not sufficient to restrict movement of cards from the card staging area through slot 328. Upon actuation of the card restraining apparatus, such as after detection of an alarm condition by the control system, the tension of biasing members 358 and 360 is increased to increase the biasing force upon which barrier 348 applies to the front card in the card staging area, thus preventing the removal of a card from the card staging area or the insertion of a card into the card staging area.

FIGS. 10-13 Illustrate a ramp 432 which includes a movement resisting feature which may be incorporated in any shoe, such as those disclosed herein. Ramp 432 includes a cylindrical roller 462 mounted on a axle 464 extending longitudinally between opposing side walls 420 and 422 and mounted thereto. Roller 462 further includes an axial disc 466 having a plurality of radially extending spurs 468. Disc 466 is configured to connect to roller 462 about axle 464 and rotates simultaneously with roller 462. The diameter of roller 462 is at least greater than the plurality of radially extending spurs 468, such that the outer surface of roller 462 may contact a surface, such as a table surface, while spurs 468 do not contact the surface. A lever 470 having a first end 472 and an opposing second end 474 includes a bore for receiving an axle 476, which extends between opposing side walls 420 and 422. Lever 470 is biased, which may be facilitated by any means such as a spring, towards the first end 472 such that the first end 472 extends from an elongated slot 478 defined in ramp 432, as shown in FIG. 12. Lever 470 is in alignment with spurs 468 of disc 466, which may be centrally located on axle 464 within roller 462. In the biased position, second end 474 contacts at least one spur 468 of disc 466, thus preventing rotation of disc 466 about axle 464. By preventing rotation of disc 466, roller 462 is also prevented from rotational motion about axle 464. Pressure applied to the first end 472 of lever 470 to overcome the bias results in a pivoting action of lever 470, as shown in FIG. 13. As such, the pivoting of lever 470 causes second end 474 to release from contact with at least one of the radially extending spurs 468 so that disc 466 and roller 462 may rotate freely. In operation, a card 426 drawn from a shoe employing ramp 432 would provide sufficient pressure to overcome the bias of lever 470 resulting in second end 474 being released so that roller 462 may rotate, but restricting movement of a shoe relative to a table surface at other times.

It should be understood that the term camera is intended to have its broadest meaning to include any component that accepts radiation (including visible radiation, infrared, ultraviolet, etc.) and provides a signal based on variations of the radiation received. This can be a digital camera or an analog camera with a decoder such as a digitizer, or receiver that converts the received radiation into signals that can be analyzed with respect to image content. The signals may reflect either color or black-and-white information or merely measure shifts in color density and pattern. Area detectors, semiconductor converters, optical fiber transmitters to sensors or the like may be used. Any convenient software may be used that can convert to radiation signals to information that can identify the suit/rank of a card from the received signal. The term camera is not intended to be limited in the underlying nature of its function. Lenses may or may not be needed to focus light, mirrors may or may not be needed to direct light and additional radiation emitters (lights, bulbs, etc.) may or may not be needed to assure sufficient radiation intensity for imaging by the camera.

Those skilled in the art will readily appreciate that the control system of the invention may include various computer and network related software and hardware, such as programs, operating systems, memory storage devices, data input/output devices, data processors, servers with links to data communication systems, wireless or otherwise, and data transceiving terminals, and may be a standalone device, incorporated in the shoe or another platform, such as a mobile device. Those skilled in the art will further appreciate that the precise types of software and hardware used are not vital to the full implementation of the system and methods of the invention.

Software for use with the control system may be configured for real time evaluation of the card values as well as wagering actions of all players. As each card image is received, the control system recognizes the images printed on the face of each card. The control system, including software, will keep track of the card rank and suit, and value in the game, the number of cards played, and the rank and suit of the cards which should remain in the card staging area, and along with other devices, such as bet sensors, be able to determine when a player wagers and how well a player is playing in the game. The control system may be configured for communication to a LAN or WAN server CPU or mainframe computer system.

It should be readily apparent that additional computerized or manual systems may also be employed in accordance with the invention in order to achieve its full implementation as a system, apparatus or method or provided added features. The shoes described herein may be integrated with other components, subcomponents and systems that exist on gaming tables such elements as bet sensors, display devices, progressive jackpot meters, play analysis systems, wagering analysis systems, player reward or comp systems, player movement analysis systems, security systems, and the like may be provided in combination with the shoe and control system described herein.

While exemplary systems and methods, and applications of methods of the invention, have been described herein, it should also be understood that the foregoing is only illustrative of a few particular embodiments with exemplary and/or preferred features, as well as principles of the invention, and that various modifications can be made by those skilled in the art without departing from the scope and spirit of the invention. Therefore, the described embodiments should not be considered as limiting of the scope of the invention in any way. Accordingly, the invention embraces alternatives, modifications and variations which fall within the spirit and scope of the invention as set forth in the claims and equivalents thereto.

What is claimed is:

1. A card dealing shoe for facilitating play of card games, comprising:

a) an elongated housing defining a card staging area therein, the housing including a front end portion having a base including a first opening, a sloped upper surface having a second opening therein, opposing side walls and a sloped front wall separated from the sloped upper surface to form a card feed slot from which cards may be manually removed from the card staging area;

b) a roller mounted for rotational motion on an axle connected at each of the opposing side walls, the roller including an outer surface extending radially from the axle to be positioned to be exposed through the first opening in the base and c) a pivoting lever having a first end and an opposing second end, wherein the first end protrudes from the second opening in the sloped upper surface, the pivoting lever configured to pivot between a first position and a second position, wherein in the first position, the first end protrudes from the second opening in the sloped upper surface and the second end restricts rotational motion of the roller, and in the second position, the first end is pivoted in the direction of the second opening and the second end is pivoted to permits rotational motion of the roller, wherein the pivoting lever is biased towards the first position.

2. A card dealing shoe as recited in claim 1, further comprising a disc connected to the roller for simultaneous rotational motion therewith, the disc including a plurality of radially extending spurs, wherein the diameter of the roller is greater than the diameter of the disc including the radially extending spurs, and the second end of the pivoting lever is positioned to come into contact with at least one of the radially extending spurs when the pivoting lever is in the first position.

3. A card dealing shoe as recited in claim 1, wherein a card being manually removed from the card staging area comes into contact with the first end of the pivoting lever.

4. A card dealing shoe as recited in claim 1, wherein the pivoting lever is mounted on an axle extending between the opposing side walls.

5. A card dealing shoe for facilitating play of card games, comprising:

a) an elongated housing defining a card staging area therein, the housing including a front end portion having a base including a first opening, a sloped upper surface having a second opening therein, opposing side walls and a sloped front wall separated from the sloped upper surface to form a card feed slot from which cards may be manually removed from the card staging area;

b) a roller mounted for rotational motion on an axle connected at each of the opposing side walls, the roller including an outer surface radially positioned through the first opening in the base;

c) a disc connected to the roller for simultaneous rotational motion therewith, the disc including a plurality of radially extending spurs, wherein the diameter of the roller is greater than the diameter of the disc including the radially extending spurs; and d) a pivoting lever having a first end and an opposing second end, wherein the first end protrudes from the second opening in the sloped upper surface the pivoting lever being configured to pivot between a first position and a second position, wherein in the first position the first end protrudes from the second opening and the second end of the pivoting lever is positioned to come into contact with at least one of the radially extending spurs, and wherein the lever is biased towards the first position.

6. A card dealing shoe as recited in claim 5, wherein a card being manually removed from the card staging area comes into contact with the first end of the pivoting lever.

7. A card dealing shoe as recited in claim 5, wherein the pivoting lever is mounted on an axle extending between the opposing side walls.

8. A card dealing shoe as recited in claim 5, wherein the second end moves from contact with the at least one of the radially extending spurs upon the lever being positioned in the second position.

* * * * *